US009427980B1

(12) United States Patent
Ito et al.

(10) Patent No.: US 9,427,980 B1
(45) Date of Patent: Aug. 30, 2016

(54) INKJET PRINTER

(71) Applicant: MIMAKI ENGINEERING CO., LTD., Nagano (JP)

(72) Inventors: Shin Ito, Nagano (JP); Tomohiro Takano, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/060,601

(22) Filed: Mar. 4, 2016

(30) Foreign Application Priority Data

Mar. 6, 2015 (JP) ..... 2015-045360

(51) Int. Cl.
*B41J 29/393* (2006.01)
*B41J 11/00* (2006.01)
*B41J 2/01* (2006.01)

(52) U.S. Cl.
CPC ..... *B41J 11/0085* (2013.01); *B41J 2/01* (2013.01)

(58) Field of Classification Search
CPC ..... B41J 13/0009; B41J 15/04; B41J 11/42; B41J 11/008; B41J 2/04501; B41J 13/02; B41J 13/103
See application file for complete search history.

(56) References Cited

U.S. PATENT DOCUMENTS 7,341,326 B2 * 3/2008 Kondo ..... G03G 15/65 347/19
8,876,278 B2 * 11/2014 Kobayashi ..... B41J 2/1721 347/101
8,955,941 B2 * 2/2015 Imoto ..... B41J 2/04501 347/16

FOREIGN PATENT DOCUMENTS

JP 5125678 1/2013

* cited by examiner

*Primary Examiner* — Lamson Nguyen
(74) *Attorney, Agent, or Firm* — Jianq Chyun IP Office

(57) ABSTRACT

An inkjet printer capable of suppressing a reduction in adsorption power relative to media as compared to the related art is provided. The inkjet printer includes a medium adsorbing device that has a medium adsorbing unit for adsorbing a medium, and an inkjet head that faces a portion of the medium adsorbing unit with a medium interposed therebetween. The medium adsorbing unit has a plurality of suction holes for sucking gas in order to adsorb a medium on an adsorption surface positioned on a side of the inkjet head. The medium adsorbing unit has a printing section and a downstream side adjacent section on a side of the adsorption surface. In the printing section, printing is performed on each medium by the inkjet head.

10 Claims, 16 Drawing Sheets

INKJET PRINTER

CROSS REFERENCE TO RELATED APPLICATIONS

This application claims the priority benefit of Japan Application No. 2015-045360, filed on Mar. 6, 2015. The entirety of the above-mentioned patent application is hereby incorporated by reference herein and made a part of this specification.

TECHNICAL FIELD

The disclosure relates to an inkjet printer which conveys a medium while adsorbing the medium for printing.

DESCRIPTION OF THE BACKGROUND ART

In the related art, there is known an inkjet printer which conveys a medium while adsorbing the medium for printing, and includes a medium adsorbing device including a medium adsorbing unit for adsorbing a medium, an inkjet head configured so as to face a portion of the medium adsorbing unit with a medium interposed therebetween and perform printing on the medium with ink, and a medium conveying device for conveying a medium adsorbed by the medium adsorbing device, with respect to the medium adsorbing unit (see Patent Document 1 for instance). The medium adsorbing unit disclosed in Patent Document 1 has a surface formed on the inkjet head side and serving as an adsorption surface for adsorbing a medium, and the adsorption surface has a plurality of suction holes for sucking gas in order to adsorb a medium. Also, the medium adsorbing unit disclosed in Patent Document 1 has a printing section where printing is performed on media by the inkjet head, an upstream side adjacent section which is on the upstream side from the printing section in the medium conveyance direction of the medium conveying device and is adjacent to the printing section, and a downstream side adjacent section which is on the downstream side from the printing section in the medium conveyance direction and is adjacent to the printing section. In the upstream side adjacent section of the medium adsorbing device disclosed in Patent Document 1, as it goes to the downstream side in the medium conveyance direction of the medium conveying device, a high adsorption power range in the main scan direction of the inkjet head expands toward both end sides in the main scan direction. Therefore, it is possible to remove wrinkles of media while the media are conveyed.

[Patent Document 1] JP 5125678B

SUMMARY

However, in the inkjet printer disclosed in Patent Document 1, adsorption power in the downstream side adjacent section is higher than adsorption power in the printing section, and thus it is likely that ink mist generated by printing of the inkjet head on media is sucked from the suction holes of the downstream side adjacent section. Therefore, the inkjet printer disclosed in Patent Document 1 has a problem that the inside of the medium adsorbing device is clogged by the sucked ink, resulting in a reduction in the adsorption power of the medium adsorbing device.

Therefore, the disclosure provides an inkjet printer capable of suppressing a reduction in adsorption power relative to media as compared to the related art.

An inkjet printer of the disclosure includes: a medium adsorbing device that includes a medium adsorbing unit which adsorbs a medium; an inkjet head which faces a portion of the medium adsorbing unit with the medium interposed therebetween and perforins printing on the medium with ink; and a medium conveying device that conveys the medium with respect to the medium adsorbing unit, wherein the medium adsorbing unit has an adsorption surface which adsorbs the medium, and the medium adsorbing unit has a printing section and a downstream side adjacent section on a side of the adsorption surface, and in the printing section, printing is performed on the medium by the inkjet head, and the downstream side adjacent section is on a downstream side from the printing section in a medium conveyance direction of the medium conveying device and is adjacent to the printing section, and in the medium adsorbing device, adsorption power in the downstream side adjacent section is equal to or lower than adsorption power in the printing section.

According to this configuration, in the inkjet printer of the disclosure, since adsorption power in the downstream side adjacent section is equal to or lower than adsorption power in the printing section, as compared to the related art, it is more difficult that ink mist generated by printing of the inkjet head on media is sucked by the suction holes of the downstream side adjacent section. For this reason, the inkjet printer of the disclosure can suppress the inside of the medium adsorbing device from being clogged by ink sucked from the suction holes of the downstream side adjacent section. Therefore, the inkjet printer of the disclosure can suppress a reduction in adsorption power relative to media as compared to the related art.

Also, in the inkjet printer of the disclosure, the medium adsorbing unit may have an upstream side adjacent section on the side of the adsorption surface, and the upstream side adjacent section may be on an upstream side from the printing section in the medium conveyance direction and be adjacent to the printing section, and in the medium adsorbing device, adsorption power in the printing section may be lower than adsorption power in the upstream side adjacent section.

According to this configuration, since adsorption power in the upstream side adjacent section positioned on the upstream side from the printing section is set to be higher than that in the printing section such that media can be conveyed in a sufficiently flat state to the printing section, the inkjet printer of the disclosure can improve the qualities of images which are printed on media by the inkjet head. Also, since adsorption power in the printing section is lower than that in the upstream side adjacent section, the inkjet printer of the disclosure can suppress ink mist generated by printing of the inkjet head on media from being sucked by the suction holes of the printing section. For this reason, the inkjet printer of the disclosure can suppress the inside of the medium adsorbing device from being clogged by ink sucked from the suction holes of the printing section. Therefore, the inkjet printer of the disclosure can suppress a reduction in adsorption power relative to media.

Also, in the inkjet printer of the disclosure, the medium adsorbing device may include a suction power generating unit which generates gas suction power, and in the adsorption surface, a plurality of suction holes may be formed so as to suck gas for adsorbing the medium, and the medium adsorbing unit may have a connection opening which is connected to the suction power generating unit, and connection chambers which connect the suction holes to the connection opening, and in the medium adsorbing unit, the connection opening may be formed at a position corresponding to the upstream side adjacent section.

According to this configuration, since the medium adsorbing unit has a connection opening forming at a position corresponding to the upstream side adjacent section, the inkjet printer of the disclosure can make the upstream side adjacent section of the upstream side adjacent section, the printing section, and the downstream side adjacent section have the highest adsorption power, with a simple configuration.

Also, in the inkjet printer of the disclosure, the inkjet head may be movable in a main scan direction intersecting with the medium conveyance direction, and in the medium adsorbing unit, a plurality of connection openings may be formed in line in the main scan direction, and the connection chambers may have grooves which extend in the medium conveyance direction and are connected to the suction holes.

According to this configuration, since the plurality of connection openings is formed in line in the main scan direction, the inkjet printer of the disclosure can uniformize adsorption power in the main scan direction. Therefore, the inkjet printer of the disclosure can surely adsorb media even at the end portions of the medium adsorbing unit in the main scan direction.

Also, in the inkjet printer of the disclosure, the medium adsorbing device may include a connection state changing device which can change at least the connection states between the suction power generating unit and a portion of connection openings of the plurality of connection openings.

According to this configuration, since the connection states between the suction power generating unit and some connection openings of the plurality of connection openings can be changed by the connection state changing device, whereby the suction power generation position in the main scan direction in the medium adsorbing unit can be changed, in a case where the width of a medium in the main scan direction changes, the inkjet printer of the disclosure can suppress ink mist from being sucked from some suction holes included in the plurality of suction holes of the medium adsorbing unit and having not faced the medium. Therefore, in a case where the width of a medium in the main scan direction changes, the inkjet printer of the disclosure can suppress a reduction in adsorption power relative to the medium.

Also, in the inkjet printer of the disclosure, the inkjet head may be movable in a main scan direction intersecting with the medium conveyance direction, and the medium adsorbing unit may have an upstream side section on the adsorption surface, and the upstream side section is on the upstream side from the upstream side adjacent section in the medium conveyance direction, and in the upstream side section of the medium adsorbing device, a high adsorption power range in the main scan direction may expand as going toward the downstream side in the medium conveyance direction.

According to this configuration, since the upstream side adjacent section of the upstream side adjacent section, the printing section, and the downstream side adjacent section has the highest adsorption power, such that it is possible to remove wrinkles of media while the media are conveyed on the upstream side of the upstream side adjacent section, the inkjet printer of the disclosure can convey media in a sufficiently flat state to the printing section. Therefore, the inkjet printer of the disclosure can improve the qualities of images which are printed on media by the inkjet head.

Also, in the inkjet printer of the disclosure, the medium conveying device may include a mesh-like conveyance belt which is on the adsorption surface, and on which the medium is loaded, and which conveys the medium with respect to the medium adsorbing unit.

According to this configuration, since the mesh-like conveyance belt is disposed between the medium adsorbing unit and a media, the inkjet printer of the disclosure can broaden the effective range of adsorption power which is generated from the suction holes of the medium adsorbing unit, according to the internal space of the mesh-like conveyance belt. For this reason, the inkjet printer of the disclosure can suppress adsorption power from extremely changing at the boundaries between the individual sections of the medium adsorbing unit. Therefore, the inkjet printer of the disclosure can suppress wrinkles from being formed in media at the boundaries between the individual sections of the medium adsorbing unit while the media are conveyed.

The inkjet printer of the disclosure can suppress a reduction in adsorption power relative to media as compared to the related art.

DETAILED DESCRIPTION OF EMBODIMENTS

Hereinafter, embodiments of the disclosure will be described with reference to the drawings.

First Embodiment

First, the configuration of an inkjet printer according to the first embodiment will be described.

Figure 1:
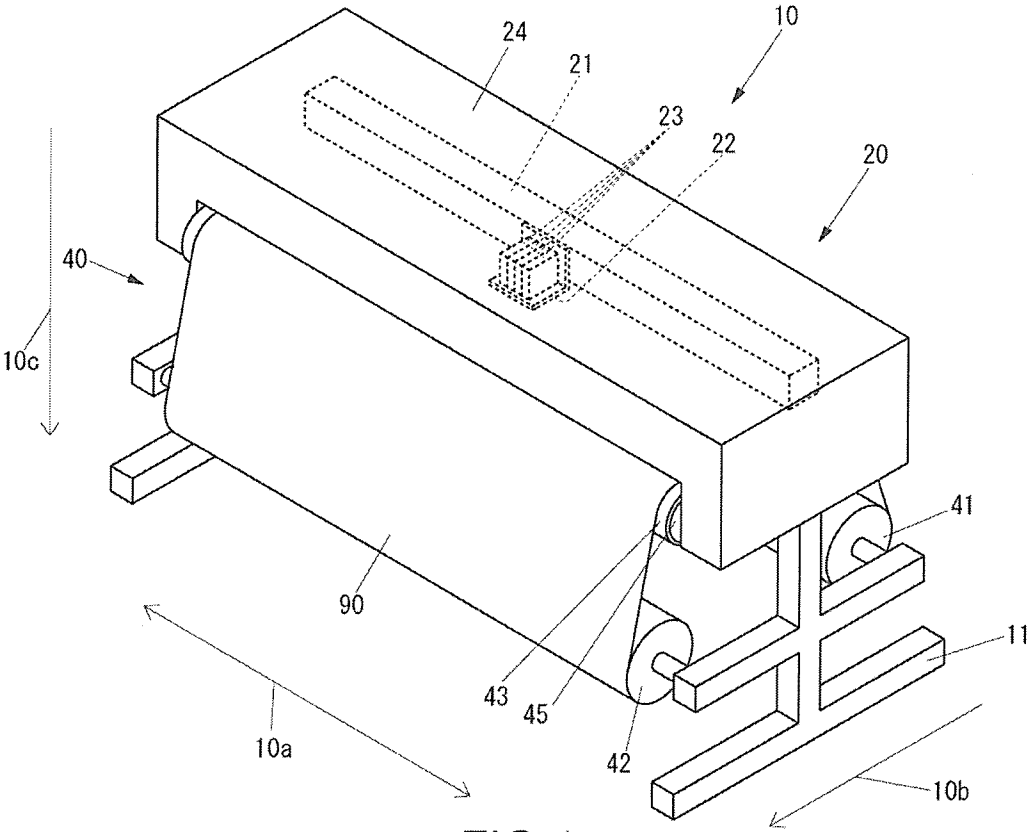
FIG. 1 is a perspective view of the external appearance of an inkjet printer according to a first embodiment of the disclosure.
Figure 2:
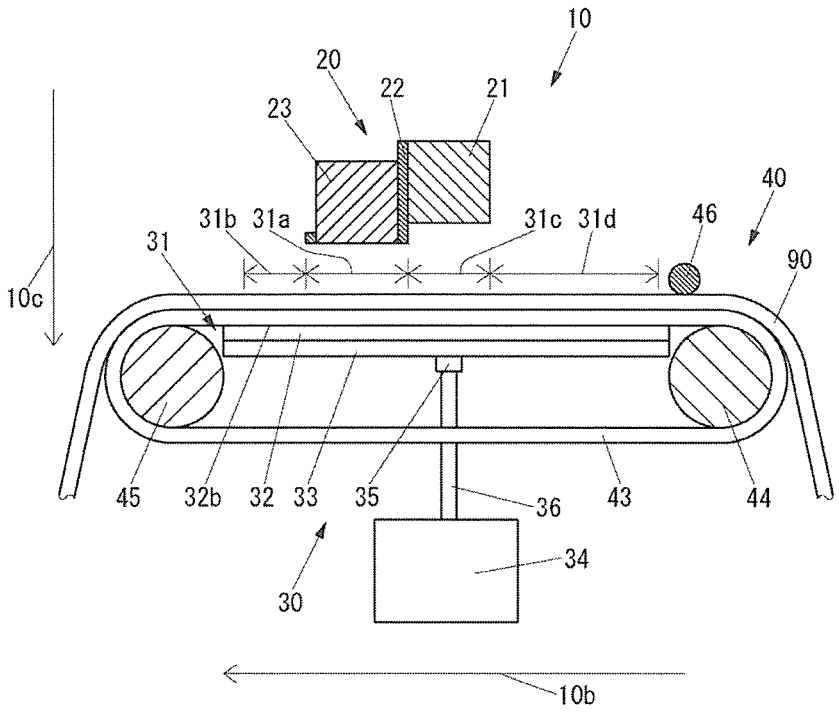
FIG. 2 is a cross-sectional view of a portion of the inkjet printer shown in FIG. 1 as seen from the right side thereof.
Figure 3:
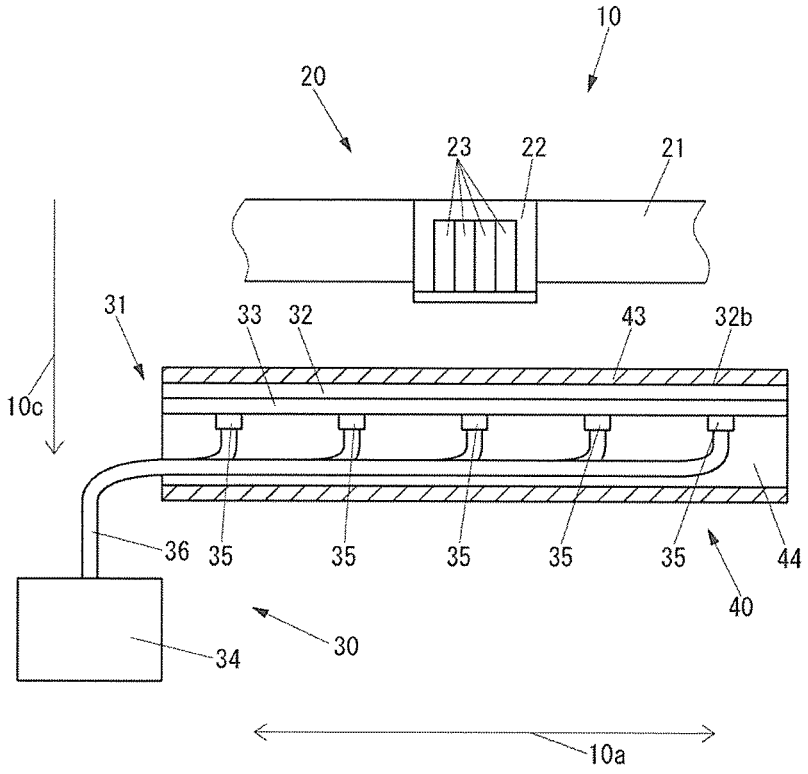
FIG. 3 is a cross-sectional view of a portion of the inkjet printer shown in FIG. 1 as seen from the front side thereof.

FIG. 1 is a perspective view illustrating the external appearance of an inkjet printer 10 according to the first embodiment. FIG. 2 is a cross-sectional view of a portion of the inkjet printer 10 as seen from the right side thereof. FIG. 3 is a cross-sectional view of a portion of the inkjet printer 10 as seen from the front side thereof.

As shown in FIGS. 1 to 3, the inkjet printer 10 includes a leg part 11 which is installed on a floor, a main body 20 which is supported on the leg part 11 and extends in a direction shown by an arrow 10*a*, a medium adsorbing device 30 which includes a medium adsorbing unit 31 for adsorbing each medium 90, and a medium conveying device 40 which conveys each medium 90 adsorbed by the medium adsorbing device 30, with respect to the medium adsorbing unit 31, in a sub scan direction shown by an arrow 10*b* and perpendicular to the direction shown by the arrow 10*a*.

The main body 20 includes a Y bar 21 which extends in the direction shown by the arrow 10*a* and serves as a guide rail, a carriage 22 which is supported on the Y bar 21 so as to be movable in a main scan direction shown by the arrow 10*a*, a plurality of inkjet heads 23 which is mounted on the carriage 22 and ejects ink toward each medium 90, a control unit (not shown) which controls the operation of the whole of the inkjet printer 10, and a case 24 which covers the Y bar 21, the carriage 22, the inkjet heads 23, and the control unit.

The inkjet heads 23 eject ink in a direction shown by an arrow 10*c* and perpendicular to both of the direction shown by the arrow 10*a* and the direction shown by the arrow 10*b*, in a state where they face a portion of the medium adsorbing unit 31 with a medium 90 interposed therebetween, thereby performing printing on the medium 90 with ink.

The control unit includes, for example, a central processing unit (CPU), a read only memory (ROM) which retains programs and a variety of data in advance, and a random access memory (RAM) which is usable as a work area of the CPU. The CPU is configured so as to execute the programs retained in the ROM.

The medium adsorbing device 30 includes the medium adsorbing unit 31 described above, a negative-pressure generating device 34 which serves as a suction power generating unit for generating gas suction power, five valves 35 connected to the medium adsorbing unit 31, and pipes 36 which connect the negative-pressure generating device 34 and the valves 35.

The medium adsorbing unit 31 includes an adsorption panel 32 which is disposed on a side of the medium 90, and a base plate 33 which the adsorption panel 32 is superimposed on and is fixed to and which the valves 35 are connected to.

Also, the lengths of the pipes 36 are designed such that all of the lengths of gas suction routes from the negative-pressure generating device 34 to the five valves 35 become the same.

The medium conveying device 40 includes an unwinding roller 41 which is supported on the leg part 11 and unwinds a medium 90, a winding roller 42 which is supported on the leg part 11 and winds the medium 90, a conveyance belt 43 on which the medium 90 is loaded and which conveys the medium 90 with respect to the medium adsorbing unit 31, a roller 44 and a roller 45 which drive the conveyance belt 43, and a roller 46 which presses the conveyance belt 43 against the medium 90.

The unwinding roller 41, the winding roller 42, the roller 44, the roller 45, and the roller 46 extend in the direction shown by the arrow 10*a*.

The conveyance belt 43 is a mesh-like belt made from a material by knitting. For example, the conveyance belt 43 is a belt having a thickness of about 2 mm. The conveyance belt 43 is an endless belt formed in an annular shape such that the medium adsorbing unit 31 can be inserted into the conveyance belt in the direction shown by the arrow 10*c*.

Figure 4:
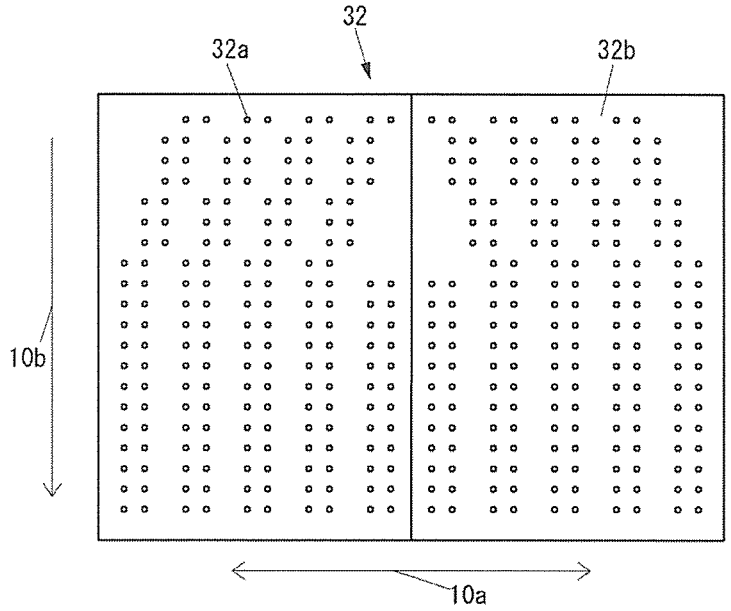
FIG. 4 is a plan view of an adsorption panel shown in FIG. 2.

FIG. 4 is a plan view of the adsorption panel 32.

As shown in FIGS. 2 to 4, the adsorption panel 32 has an adsorption surface 32*b* for adsorbing a medium 90, and a plurality of suction holes 32*a* formed on a side of the adsorption surface 32*b* so as to suck gas in order to adsorb a medium 90. The suction holes 32*a* are formed in the direction shown by the arrow 10*c*.

Figure 5A:
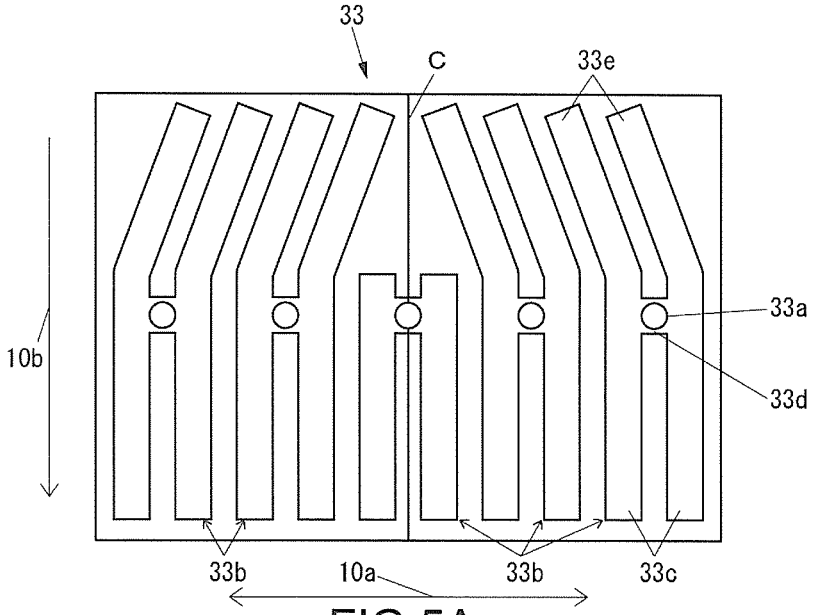
FIG. 5A is a plan view of a base plate shown in FIG. 2.
Figure 5B:
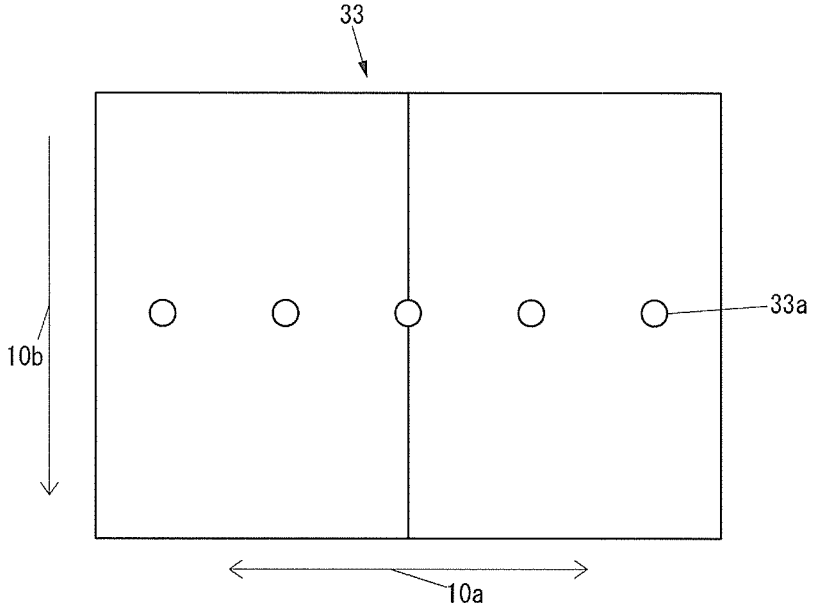
FIG. 5B is a bottom view of the base plate shown in FIG. 2.

FIG. 5A is a plan view of the base plate 33. FIG. 5B is a bottom view of the base plate 33.

As shown in FIGS. 2, 3, 5A and 5B, the base plate 33 has five connection openings 33*a* formed so as to be connected to the negative-pressure generating device 34 through the valves 35 and the pipes 36, and five connection chambers 33*b* formed so as to connect the suction holes 32*a* (see FIG. 4) of the adsorption panel 32 to the connection openings 33*a*.

The five connection openings 33*a* are formed in line in the main scan direction shown by the arrow 10*a*. The five connection openings 33*a* are formed in the direction shown by the arrow 10*c*, on the opposite side to the adsorption panel 32 side, and are connected to the valves 35, respectively.

The valves 35 can change the connection states between the negative-pressure generating device 34 and the connection openings 33*a*, and constitute a connection state changing device.

As shown in FIGS. 5A and 5B, each of the five connection chambers 33*b* has two grooves 33*c* extending in a medium conveyance direction shown by the arrow 10*b*. Also, each of the five connection chambers 33*b* has a groove 33*d* connecting two grooves 33*c* to a corresponding connection opening 33*a*. Also, among the five connection chambers 33*b*, each of two connection chambers 33*b* positioned on each side in the direction shown by the arrow 10*a* has two grooves 33*e* extending while being inclined from the medium conveyance direction shown by the arrow 10*b* toward the main scan direction shown by the arrow 10*a*. Each groove 33*e* is inclined toward the center in the direction shown by the arrow 10*a* as it goes toward the upstream side in the medium conveyance direction shown by the arrow 10*b*. The grooves 33*e* are connected to corresponding grooves 33*c*. The grooves 33*c* and the grooves 33*e* are directly connected to corresponding suction holes 32*a*.

Figure 6:
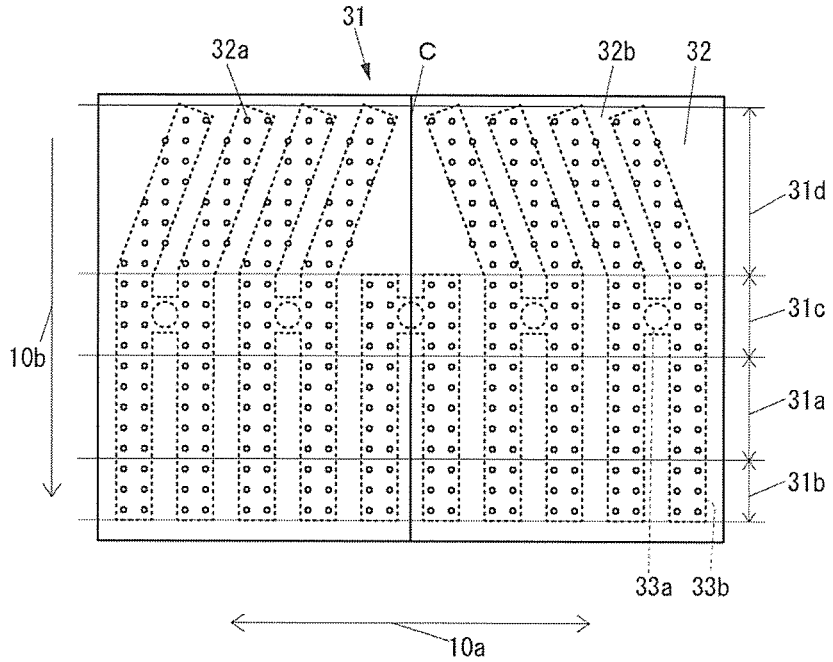
FIG. 6 is a plan view of a medium adsorbing unit shown in FIG. 2.

FIG. 6 is a plan view of the medium adsorbing unit 31.

As shown in FIGS. 2, 3, and 6, the medium adsorbing unit 31 has the adsorption surface 32*b* which has a printing section 31*a* where printing is performed on each medium 90 by the inkjet heads 23, a downstream side adjacent section 31*b* which is on the downstream side from the printing section 31*a* in the medium conveyance direction in which the medium conveying device 40 conveys each medium 90 and which is shown by the arrow 10*b* and is adjacent to the printing section 31*a*, an upstream side adjacent section 31*c* which is on the upstream side from the printing section 31*a* in the medium conveyance direction shown by the arrow 10*b* and is adjacent to the printing section 31*a*, and an upstream side section 31*d* which is on the upstream side from the upstream side adjacent section 31*c* in the medium conveyance direction shown by the arrow 10*b*.

The printing section 31*a* is a section where the medium adsorbing unit adsorbs each medium 90 in order to prevent the corresponding medium 90 from coming into contact with the inkjet heads 23.

The downstream side adjacent section 31*b* is a section where the medium adsorbing unit weakly adsorbs each medium 90 on the conveyance belt 43 such that the corresponding medium 90 can be easily detached from the conveyance belt 43.

The upstream side adjacent section 31*c* is a section interposed between the Y bar 21 and the adsorption surface 32*b* of the adsorption panel 32 or a partial section of the adsorption surface 32*b*, and is a section where the medium adsorbing unit strongly adsorbs each medium 90 on the conveyance belt 43 such that the corresponding medium 90 can be conveyed in a flat state to the printing section 31*a*.

The upstream side section 31*d* is a section where the medium adsorbing unit adsorbs each medium 90 such that the corresponding medium 90 can be adsorbed onto the conveyance belt 43 in a state where it is flat without wrinkles.

Now, the operation of the inkjet printer 10 will be described.

If print data is received from a computer such as a personal computer (PC) (not shown), the control unit of the inkjet printer 10 prints images based on the received print data on a medium 90 with ink. Specifically, the control unit ejects ink toward the medium 90 by the inkjet heads 23 while changing the relative positions of the inkjet heads 23 to the medium 90. Here, in a case of changing the relative positions of the inkjet heads 23 to the medium 90 in the main scan direction shown by the arrow 10*a*, the control unit moves the carriage 22 along the Y bar 21 in the main scan direction shown by the arrow 10*a*. Also, in a case of changing the relative positions of the inkjet heads 23 to the medium 90 in the sub scan direction shown by the arrow 10*b*, the control unit controls the medium conveying device 40 such that the medium conveying device moves the medium 90 in the sub scan direction shown by the arrow 10*b*. Also, while printing is performed on the medium 90, the control unit performs control such that the medium adsorbing device 30 adsorbs the medium 90. In other words, in order for printing, the inkjet printer 10 conveys the medium 90 by the medium conveying device 40 while adsorbing the medium by the medium adsorbing device 30.

Conveyance of the medium 90 by the medium conveying device 40 will be described in detail. The control unit drives at least one of the roller 44 and the roller 45, thereby rotating the conveyance belt 43. Therefore, the medium 90 pressed against the conveyance belt 43 by the roller 46 is loaded on the conveyance belt 43, and is moved with respect to the medium adsorbing unit 31 in the sub scan direction shown by the arrow 10*b*. Also, the control unit unwinds the medium 90 by the unwinding roller 41 and winds the medium 90 by the winding roller 42 as the conveyance belt 43 conveys the medium 90.

Adsorption of a medium 90 by the medium adsorbing device 30 will be described in detail. In a case of adsorbing a medium 90 by the medium adsorbing device 30, the control unit drives the negative-pressure generating device 34. If the negative-pressure generating device 34 is driven, the medium adsorbing device 30 sucks gas from the suction holes 32*a* connected to the negative-pressure generating device 34 through the connection chambers 33*b*, the connection openings 33*a*, the valves 35, and the pipes 36, thereby adsorbing the medium 90 onto a side of the adsorption surface 32*b* of the adsorption panel 32.

The suction holes 32*a* of the printing section 31*a*, the suction holes 32*a* of the downstream side adjacent section 31*b*, and the suction holes 32*a* of the upstream side adjacent section 31*c* are connected to the negative-pressure generating device 34 through the grooves 33*c*. Further, the connection openings 33*a* are formed at positions corresponding to the upstream side adjacent section 31*c* of the adsorption panel 32, on the opposite side of the adsorption panel 32 to the adsorption surface 32*b* in the thickness direction of the adsorption panel 32 (the direction shown by the arrow 10*c*). In other words, the suction holes 32*a* of the printing section 31*a* are positioned farther from the connection openings 33*a* as compared to the suction holes 32*a* of the upstream side adjacent section 31*c*, such that the gas suction routes of the negative-pressure generating device 34 become long. Also, the suction holes 32*a* of the downstream side adjacent section 31*b* are positioned farther from the connection openings 33*a* as compared to the suction holes 32*a* of the printing section 31*a*, such that the gas suction routes of the negative-pressure generating device 34 become long. Here, a suction hole 32*a* farther from a corresponding connection opening 33*a* has lower gas suction power since there are many other suction holes 32*a* on the route from the corresponding connection opening 33*a* to the corresponding suction hole 32*a*. Therefore, in the medium adsorbing device 30, adsorption power in the downstream side adjacent section 31*b* is lower than adsorption power in the printing section 31*a*, and adsorption power in the printing section 31*a* is lower than adsorption power in the upstream side adjacent section 31*c*.

Also, the suction holes 32*a* of the upstream side section 31*d* are connected to the negative-pressure generating device 34 through the grooves 33*e*. As described above, each groove 33*e* is inclined toward the center line C positioned at the center in the direction shown by the arrow 10*a* as it goes toward the upstream side in the medium conveyance direction shown by the arrow 10*b*. Therefore, in the upstream side section 31*d* of the medium adsorbing device 30, a high adsorption power range in the main scan direction shown by the arrow 10*a* expands toward both end sides in the main scan direction as it goes toward the downstream side in the medium conveyance direction shown by the arrow 10*b*. Also, the high adsorption power range is axially symmetric with respect to the center line C extending in the medium conveyance direction shown by the arrow 10*b*.

As described above, in the inkjet printer 10, since adsorption power in the downstream side adjacent section 31*b* is lower than adsorption power in the printing section 31*a*, as compared to the related art, it is more difficult that ink mist generated by performing printing on media 90 by the inkjet heads 23 is sucked by the suction holes 32*a* of the downstream side adjacent section 31*b*. For this reason, the inkjet printer 10 can suppress the inside of the medium adsorbing device 30 from being clogged by ink sucked from the suction holes 32*a* of the downstream side adjacent section 31*b*, and can suppress the internal space of the conveyance belt 43 from being clogged by ink sucked by the suction holes 32*a* of the downstream side adjacent section 31*b*. Therefore, the inkjet printer 10 can suppress a reduction in adsorption power relative to media 90 as compared to the related art.

Also, in a case where adsorption power in the printing section 31*a* is lower than adsorption power in the downstream side adjacent section 31*b*, if adsorption power in the downstream side adjacent section 31*b* is reduced in order to make it difficult that ink generated by performing printing on media 90 by the inkjet heads 23 is sucked from the suction holes 32*a* of the downstream side adjacent section 31*b*, adsorption power in the printing section 31*a* lower than adsorption power in the downstream side adjacent section 31*b* becomes excessively low. In this case, since media 90 cannot be conveyed in a sufficiently flat state in the printing section 31*a*, the qualities of images which are printed on the media 90 by the inkjet heads 23 reduce. However, in the inkjet printer 10, since adsorption power in the printing section 31*a* is higher than adsorption power in the downstream side adjacent section 31*b*, it is possible to make it difficult that ink mist generated by performing printing on media 90 by the inkjet heads 23 is sucked from the suction holes 32*a* of the downstream side adjacent section 31*b*. For this reason, even if adsorption power in the downstream side adjacent section 31*b* is reduced, it is possible to sufficiently secure adsorption power in the printing section 31*a*. Therefore, the inkjet printer 10 can suppress a reduction in the qualities of images which are printed on media 90 by the inkjet heads 23.

In the inkjet printer 10, since adsorption power in the upstream side adjacent section 31*c* positioned on the upstream side from the printing section 31*a* is set to be higher than adsorption power in the printing section 31*a*, such that media 90 can be conveyed in a sufficiently flat state to the printing section 31*a*, it is possible to improve the qualities of images which are printed on media 90 by the inkjet heads 23.

Also, in the inkjet printer 10, since adsorption power in the printing section 31*a* is lower than adsorption power in the upstream side adjacent section 31*c*, it is possible to suppress ink mist generated by performing printing on media 90 by the inkjet heads 23 from being sucked by the suction holes 32*a* of the printing section 31*a*. For this reason, the inkjet printer 10 can suppress the inside of the medium adsorbing device 30 from being clogged by ink sucked from the suction holes 32*a* of the printing section 31*a* and can suppress the internal space of the conveyance belt 43 from being clogged by ink sucked by the suction holes 32*a* of the printing section 31*a*. Therefore, the inkjet printer 10 can suppress a reduction in adsorption power relative to media 90.

In the inkjet printer 10, since the connection openings 33*a* are formed at positions corresponding to the upstream side adjacent section 31*c*, on the opposite side of the medium adsorbing unit 31 to the adsorption surface 32*b* positioned on the inkjet head 23 side, it is possible to maximize adsorption power in the upstream side adjacent section 31*c* of the upstream side adjacent section 31*c*, the printing section 31*a*, and the downstream side adjacent section 31*b* by a simple configuration.

In the inkjet printer 10, since the plurality of connection openings 33*a* is formed in line in the main scan direction shown by the arrow 10*a*, it is possible to uniformize adsorption power in the main scan direction shown by the arrow 10*a*. Therefore, the inkjet printer 10 can surely adsorb media 90 even at the end portions of the medium adsorbing unit 31 in the main scan direction shown by the arrow 10*a*.

In the inkjet printer 10, since the connection states between the negative-pressure generating device 34 and some connection openings 33*a* of the plurality of connection openings 33*a* can be changed by the valves 35, whereby adsorption power generation positions on the medium adsorbing unit 31 in the main scan direction shown by the arrow 10*a* can be changed, in a case where the width of a medium 90 in the main scan direction shown by the arrow 10*a* changes, it is possible to suppress ink mist from being sucked from some suction holes 32*a* included in the plurality of suction holes 32*a* of the medium adsorbing unit 31 and having not faced the medium 90. For example, in a case where the width of a medium 90 in the main scan direction shown by the arrow 10*a* is small, both end valves 35 of the five valves 35 in the main scan direction are closed, whereby it is possible to suppress ink mist from being sucked from some suction holes 32*a* included in the plurality of suction holes 32*a* of the medium adsorbing unit 31 and having not faced the medium 90, that is, suction holes 32*a* positioned on both end sides in the main scan direction. Therefore, in a case where the widths of media 90 in the main scan direction shown by the arrow 10*a* change, the inkjet printer 10 can suppress a reduction in adsorption power relative to media 90.

In the upstream side section 31*d* of the medium adsorbing device 30, a high adsorption power range in the main scan direction shown by the arrow 10*a* expands toward both end sides in the main scan direction as it goes toward the downstream side in the medium conveyance direction shown by the arrow 10*b*. According to this configuration, since it is possible to remove wrinkles of media 90 as the media 90 are conveyed on the upstream side of the upstream side adjacent section 31*c* having the highest adsorption power among the upstream side adjacent section 31*c*, the printing section 31*a*, and the downstream side adjacent section 31*b*, the inkjet printer 10 can convey medium 90 in a sufficiently flat state to the printing section 31*a*. Therefore, the inkjet printer 10 can improve the qualities of images which are printed on media 90 by the inkjet heads 23.

In the inkjet printer 10, since the mesh-like conveyance belt 43 is disposed between the medium adsorbing unit 31 and a medium 90, it is possible to broaden the effective range of adsorption power which is generated from the suction holes 32*a* of the medium adsorbing unit 31, according to the internal space of the mesh-like conveyance belt 43. For this reason, the inkjet printer 10 can suppress adsorption power from extremely changing at the boundaries between the individual sections of the medium adsorbing unit 31, that is, the boundaries between the printing section 31*a*, the downstream side adjacent section 31*b*, the upstream side adjacent section 31*c*, and the upstream side section 31*d*. Therefore, the inkjet printer 10 can suppress wrinkles from being formed in media 90 at the boundaries between the individual sections of the medium adsorbing unit 31 as the media 90 are conveyed.

Also, the inkjet printer 10 can have various medium adsorbing units, in place of the medium adsorbing unit 31.

Figure 7:
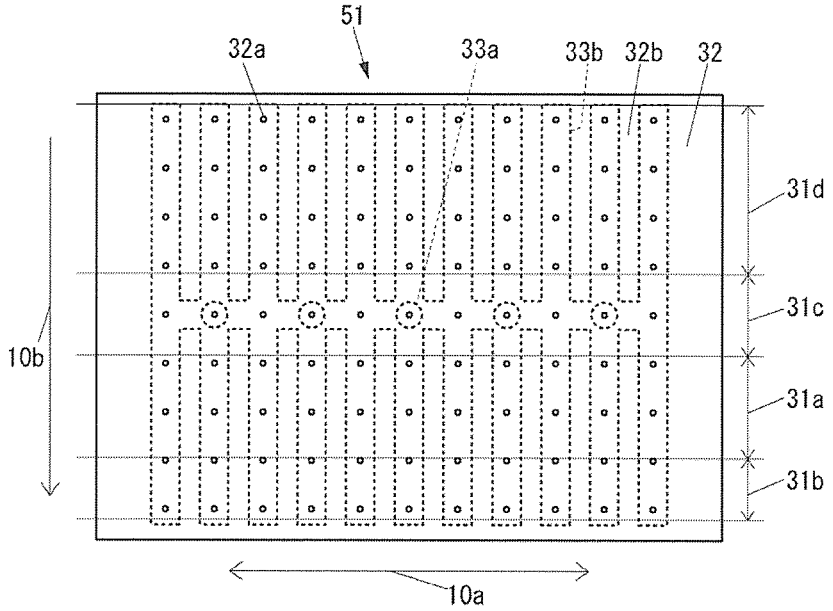
FIG. 7 is a plan view of the medium adsorbing unit shown in FIG. 2, and is a view illustrating an example different from the example shown in FIG. 6.

For example, the inkjet printer 10 may have a medium adsorbing unit 51 shown in FIG. 7, in place of the medium adsorbing unit 31. The medium adsorbing unit 51 has connection chambers 33*b* which are formed in a simple shape only by longitudinal and transverse grooves, and thus can be easily manufactured as compared to the medium adsorbing unit 31.

Figure 8:
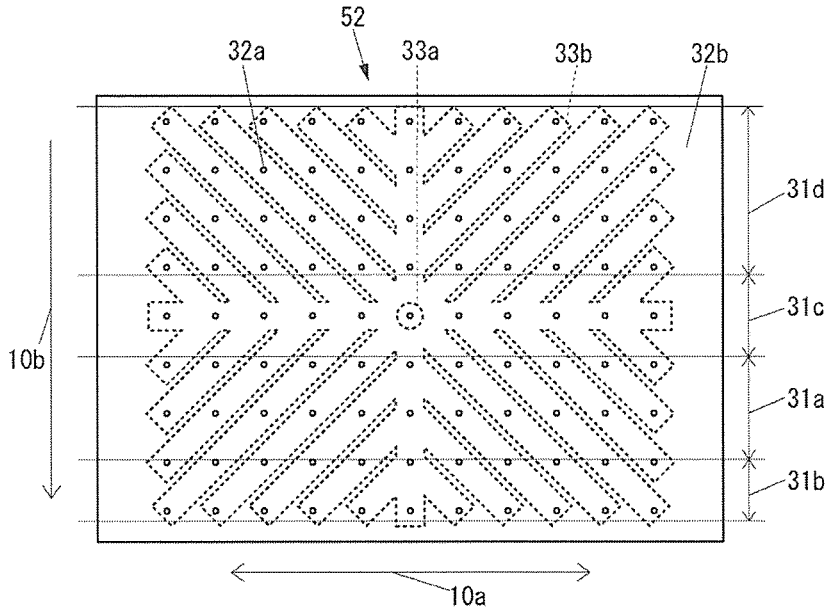
FIG. 8 is a plan view of the medium adsorbing unit shown in FIG. 2, and is a view illustrating an example different from the examples shown in FIGS. 6 and 7.

Also, the inkjet printer 10 may have a medium adsorbing unit 52 shown in FIG. 8, in place of the medium adsorbing unit 31. In the medium adsorbing unit 52, although there is only one connection opening 33*a*, it is possible to shorten a gas suction route between the connection opening 33*a* and each of the plurality of suction holes 32*a*, and thus it is possible to reduce a difference in the lengths of the gas suction routes to the connection opening 33*a* between adjacent suction holes 32*a*. In other words, in the medium adsorbing unit 52, it is possible to reduce an adsorption power difference between adjacent suction holes 32*a*.

Figure 9:
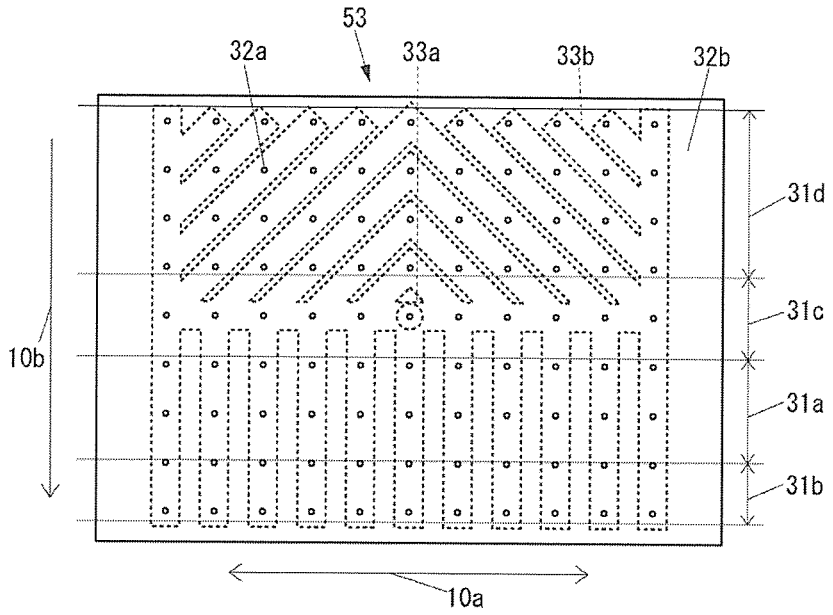
FIG. 9 is a plan view of the medium adsorbing unit shown in FIG. 2, and is a view illustrating an example different from the examples shown in FIGS. 6 to 8.

Also, the inkjet printer 10 may have a medium adsorbing unit 53 shown in FIG. 9, in place of the medium adsorbing unit 31. In the medium adsorbing unit 53, in the upstream side section 31*d*, with respect to central suction holes 32*a* and both end-side suction holes 32*a* in the main scan direction shown by the arrow 10*a*, it is possible to reduce a difference in the lengths of the gas suction routes to the connection opening 33*a*. In other words, in the upstream side section 31*d* of the medium adsorbing unit 53, it is possible to reduce an adsorption power difference between the central suction holes 32*a* and the both end-side suction holes 32*a* in the main scan direction shown by the arrow 10*a*.

Figure 10:
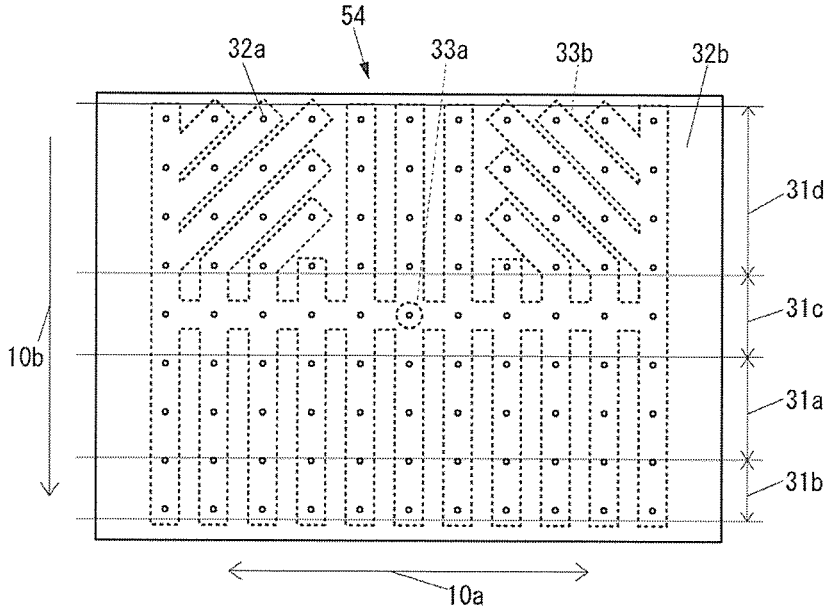
FIG. 10 is a plan view of the medium adsorbing unit shown in FIG. 2, and is a view illustrating an example different from the examples shown in FIGS. 6 to 9.

Also, the inkjet printer 10 may have a medium adsorbing unit 54 shown in FIG. 10, in place of the medium adsorbing unit 31. In the medium adsorbing unit 54, in the upstream side section 31*d*, with respect to central suction holes 32*a* and both end-side suction holes 32*a* in the main scan direction shown by the arrow 10*a*, it is possible to increase a difference in the lengths of the gas suction routes to the connection opening 33*a*. Specifically, in the upstream side section 31*d* of the medium adsorbing unit 54, it is possible to reduce the lengths of the gas suction routes between the connection opening 33*a* and the central suction holes 32*a* in the main scan direction shown by the arrow 10*a*, and increase the lengths of the gas suction routes between the connection opening 33*a* and the both end-side suction holes 32*a* in the main scan direction shown by the arrow 10*a*. In other words, in the upstream side section 31*d* of the medium adsorbing unit 53, it is possible to increase the adsorption power of the central suction holes 32*a* in the main scan direction shown by the arrow 10*a*, and reduce the adsorption power of the both end-side suction holes 32*a*. Therefore, in the upstream side section 31*d* of the medium adsorbing unit 53, it is possible to increase an adsorption power difference between the central suction holes 32*a* and the both end-side suction holes 32*a* in the main scan direction shown by the arrow 10*a*.

Figure 11:
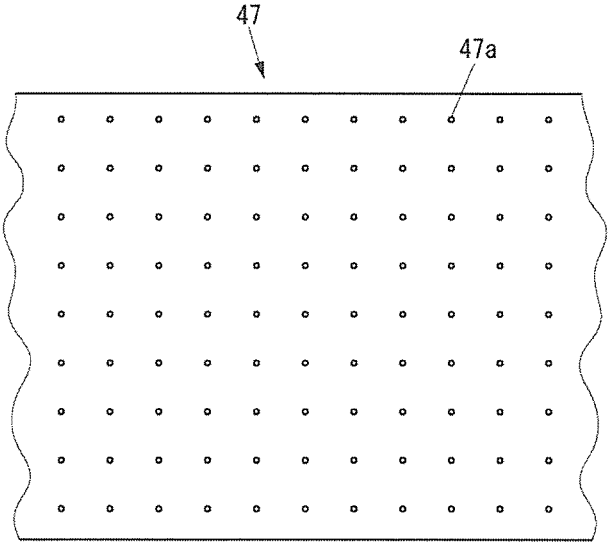
FIG. 11 is a plan view illustrating an example of a conveyance belt of the inkjet printer shown in FIG. 1.

Also, in a case where the inkjet printer 10 has a conveyance belt 47 having a plurality of through-holes 47*a* as shown in FIG. 11, in place of the mesh-like conveyance belt 43, since it is easy for adsorption power of the conveyance belt 47 to become non-uniform between a range having the through-holes 47*a* and a range having no through-holes 47*a*, as compared to the configuration having the mesh-like conveyance belt 43 as shown in FIG. 2, it is easier for wrinkles to be formed in media 90 in the boundaries between the individual sections of the medium adsorbing unit 31 while the media 90 are conveyed. However, the inkjet printer 10 may have a conveyance belt, such as the conveyance belt 47, other than the mesh-like conveyance belt 43, in place of the mesh-like conveyance belt 43.

Figure 12:
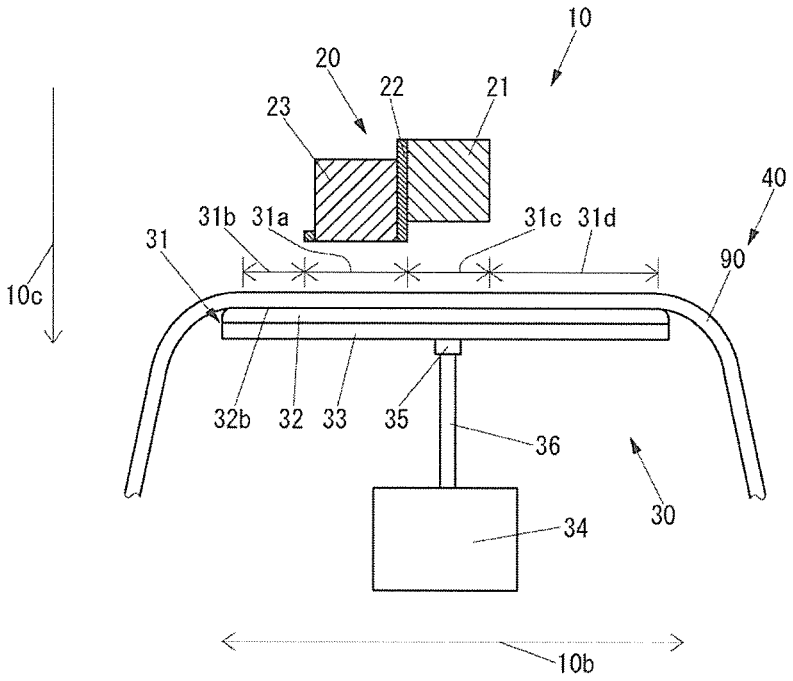
FIG. 12 is a cross-sectional view of a portion of the inkjet printer shown in FIG. 1 as seen from the right side thereof, and is a view illustrating an example different from the example shown in FIG. 2.

Also, the inkjet printer 10 may have no conveyance belt as shown in FIG. 12. In the configuration shown in FIG. 12, a medium 90 conveyed by the unwinding roller 41 (see FIG. 1) and the winding roller 42 (see FIG. 1) comes into direct contact with the adsorption surface 32*b* of the adsorption panel 32.

Second Embodiment

First, the configuration of an inkjet printer according to a second embodiment will be described.

In the configuration of the inkjet printer according to the second embodiment, components identical to the components of the inkjet printer 10 (see FIG. 1) according to the first embodiment are denoted by the same reference symbols, and will not be described.

Figure 13:
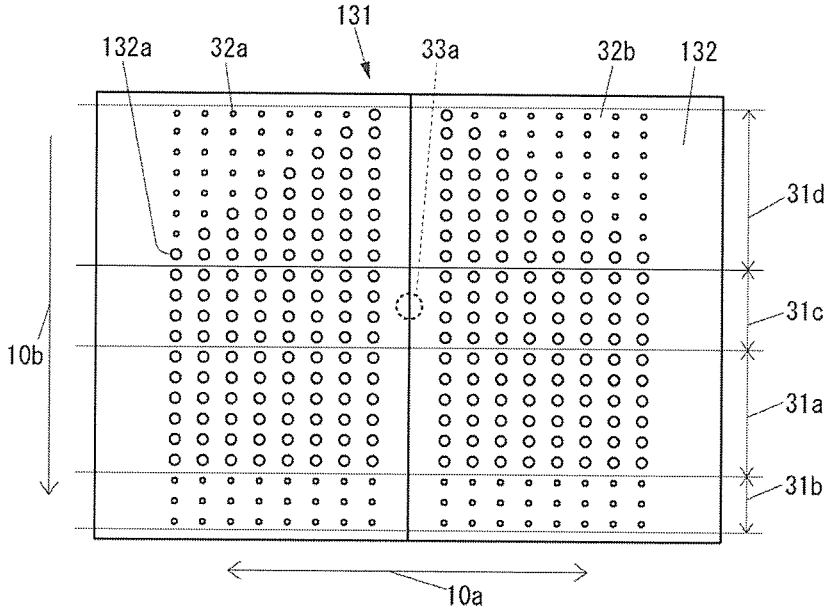
FIG. 13 is a plan view of a medium adsorbing unit of an inkjet printer according to a second embodiment of the disclosure.

The configuration of the inkjet printer according to the second embodiment is the same as a configuration which is obtained by replacing the medium adsorbing unit 31 (see FIG. 6) of the inkjet printer 10 with a medium adsorbing unit 131 shown in FIG. 13.

Figure 14:
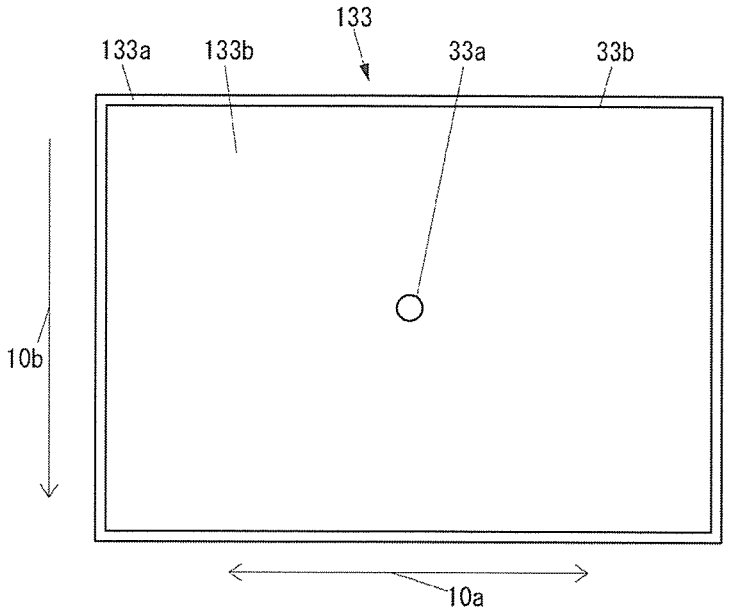
FIG. 14 is a plan view of a base plate of the medium adsorbing unit shown in FIG. 13.

FIG. 13 is a plan view of the medium adsorbing unit 131 of the inkjet printer according to the second embodiment. FIG. 14 is a plan view of a base plate 133 of the medium adsorbing unit 131.

The configuration of the medium adsorbing unit 131 is the same as the configuration of the medium adsorbing unit 31 except for a configuration to be described below.

As shown in FIGS. 13 and 14, the medium adsorbing unit 131 includes an adsorption panel 132 which is disposed on a side of the medium 90, and the base plate 133 which the adsorption panel 132 is superimposed on and is fixed to and which the valves 35 (see FIG. 2) are connected to.

The configuration of the adsorption panel 132 is the same as the configuration of the adsorption panel 32 (see FIG. 4) except that not only suction holes 32*a* but also suction holes 132*a* having a diameter larger than the diameter of the suction holes 32*a* are formed, and the suction holes 32*a* and the suction holes 132*a* are disposed as shown in FIG. 13.

The configuration of the base plate 133 is the same as the configuration of the base plate 33 (see FIGS. 5A and 5B) except that a connection chamber 33*b* is surrounded by a wall portion 133*a* and a bottom portion 133*b* and only one connection opening 33*a* is formed in the bottom portion 133*b*.

Suction holes 132*a* of the printing section 31*a* and suction holes 32*a* of the downstream side adjacent section 31*b* are connected to the negative-pressure generating device 34 (see FIG. 2) through the connection chamber 33*b*. Further, the connection opening 33*a* is formed at a position corresponding to the upstream side adjacent section 31*c* of the adsorption panel 132, on the opposite side of the adsorption panel 132 to the adsorption surface 32*b* in the thickness direction of the adsorption panel (the direction shown by the arrow 10*c*). In other words, the suction holes 32*a* of the downstream side adjacent section 31*b* are positioned farther from the connection opening 33*a* as compared to the suction holes 132*a* of the printing section 31*a*, such that the gas suction routes of the negative-pressure generating device 34 become long. Further, since the suction holes 132*a* of the printing section 31*a* are larger than the suction holes 32*a* of the downstream side adjacent section 31*b*, and thus can suck a larger amount of gas. Therefore, in the medium adsorbing unit 131, adsorption power in the downstream side adjacent section 31*b* is lower than adsorption power in the printing section 31*a*.

Also, the suction holes 132*a* of the printing section 31*a* are positioned farther from the connection opening 33*a* as compared to the suction holes 132*a* of the upstream side adjacent section 31*c*, such that the gas suction routes of the negative-pressure generating device 34 become long. Therefore, in the medium adsorbing unit 131, adsorption power in the printing section 31*a* is lower than adsorption power in the upstream side adjacent section 31*c*.

Also, in the upstream side section 31*d*, the suction holes 132*a* are disposed so as to spread toward both end sides in the main scan direction shown by the arrow 10*a* as it goes toward the downstream side in the medium conveyance direction shown by the arrow 10*b*. In the upstream side section 31*d*, the suction holes 32*a* are disposed at portions where the suction holes 132*a* are not disposed. Here, the suction holes 132*a* are larger than the suction holes 32*a*, and thus can suck a larger amount of gas. Therefore, in the upstream side section 31*d* of the medium adsorbing unit 131, a high adsorption power range in the main scan direction shown by the arrow 10*a* expands toward both end sides in the main scan direction as it goes toward the downstream side in the medium conveyance direction shown by the arrow 10*b*.

As described above, in the inkjet printer according to the second embodiment, since adsorption power in the downstream side adjacent section 31*b* is lower than adsorption power in the printing section 31*a*, as compared to the related art, it is more difficult that ink mist generated by performing printing on media 90 by the inkjet heads 23 is sucked by the suction holes 32*a* of the downstream side adjacent section 31*b*. For this reason, the inkjet printer according to the second embodiment can suppress the inside of the medium adsorbing device 30 from being clogged by ink sucked from the suction holes 32*a* of the downstream side adjacent section 31*b*, and can suppress the internal space of the conveyance belt 43 from being clogged by ink sucked by the suction holes 32*a* of the downstream side adjacent section 31*b*. Therefore, the inkjet printer according to the second embodiment can suppress a reduction in adsorption power relative to media 90 as compared to the related art.

Also, in a case where adsorption power in the printing section 31*a* is lower than adsorption power in the downstream side adjacent section 31*b*, if adsorption power in the downstream side adjacent section 31*b* is reduced in order to make it difficult that ink generated by performing printing on media 90 by the inkjet heads 23 is sucked from the suction holes 32*a* of the downstream side adjacent section 31*b*, adsorption power in the printing section 31*a* lower than adsorption power in the downstream side adjacent section 31*b* becomes excessively low, whereby media 90 cannot be conveyed in a sufficiently flat state in the printing section 31*a*, resulting in a reduction in the qualities of images which are printed on the media 90 by the inkjet heads 23. However, in the inkjet printer according to the second embodiment, since adsorption power in the printing section 31*a* is higher than adsorption power in the downstream side adjacent section 31*b*, even if adsorption power in the downstream side adjacent section 31*b* is reduced in order to make it difficult that ink mist generated by performing printing on media 90 by the inkjet heads 23 is sucked from the suction holes 32*a* of the downstream side adjacent section 31*b*, it is possible to sufficiently secure adsorption power in the printing section 31*a*. Therefore, the inkjet printer according to the second embodiment can suppress a reduction in the qualities of images which are printed on media 90 by the inkjet heads 23.

In the inkjet printer according to the second embodiment, since adsorption power in the upstream side adjacent section 31*c* positioned on the upstream side from the printing section 31*a* is set to be higher than adsorption power in the printing section 31*a*, such that media 90 can be conveyed in a sufficiently flat state in the printing section 31*a*, it is possible to improve the qualities of images which are printed on media 90 by the inkjet heads 23.

Also, in the inkjet printer according to the second embodiment, since adsorption power in the printing section 31*a* is lower than adsorption power in the upstream side adjacent section 31*c*, it is possible to suppress ink mist generated by performing printing on media 90 by the inkjet heads 23 from being sucked by the suction holes 32*a* of the printing section 31*a*. For this reason, the inkjet printer according to the second embodiment can suppress the inside of the medium adsorbing device 30 from being clogged by ink sucked from the suction holes 32*a* of the printing section 31*a* and can suppress the internal space of the conveyance belt 43 from being clogged by ink sucked by the suction holes 32*a* of the printing section 31*a*. Therefore, the inkjet printer according to the second embodiment can suppress a reduction in adsorption power relative to media 90.

In the inkjet printer according to the second embodiment, since the connection openings 33*a* are formed at positions corresponding to the upstream side adjacent section 31*c*, on the opposite side of the medium adsorbing unit 131 to the adsorption surface 32*b* positioned on the inkjet head 23 side, it is possible to maximize adsorption power in the upstream side adjacent section 31*c* of the upstream side adjacent section 31*c*, the printing section 31*a*, and the downstream side adjacent section 31*b* by a simple configuration.

In the upstream side section 31*d* of the medium adsorbing unit 131, a high adsorption power range in the main scan direction shown by the arrow 10*a* expands toward both end sides in the main scan direction as it goes toward the downstream side in the medium conveyance direction shown by the arrow 10*b*. According to this configuration, since it is possible to remove wrinkles of media 90 as the media 90 are conveyed in the upstream side of the upstream side adjacent section 31*c* having the highest adsorption power among the upstream side adjacent section 31*c*, the printing section 31*a*, and the downstream side adjacent section 31*b*, the inkjet printer according to the second embodiment can convey media 90 in a sufficiently flat state to the printing section 31*a*. Therefore, the inkjet printer according to the second embodiment can improve the qualities of images which are printed on media 90 by the inkjet heads 23.

Also, the inkjet printer according to the second embodiment can have various medium adsorbing units, in place of the medium adsorbing unit 131.

Figure 15:
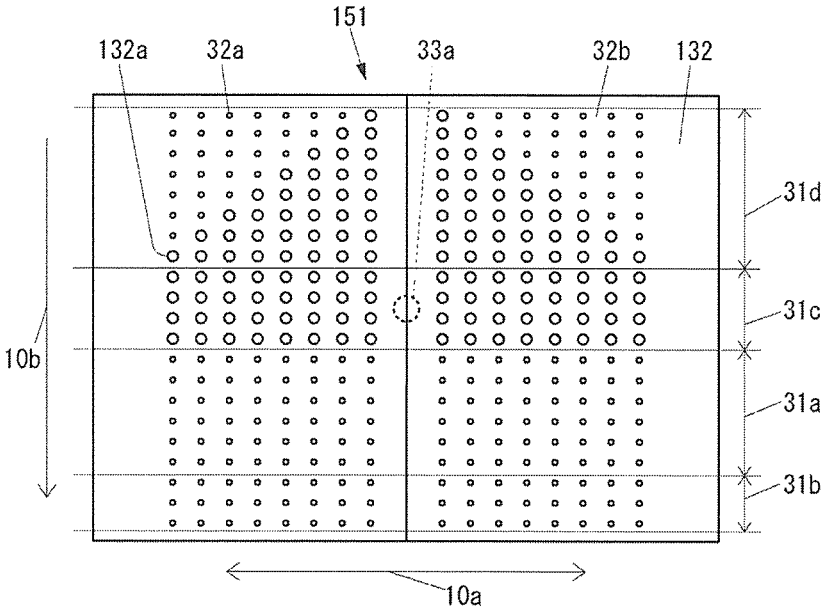
FIG. 15 is a plan view of the medium adsorbing unit of the inkjet printer according to the second embodiment of the disclosure, and is a view illustrating an example different from the example shown in FIG. 13.

For example, the inkjet printer according to the second embodiment may have a medium adsorbing unit 151 shown in FIG. 15, in place of the medium adsorbing unit 131.

In the medium adsorbing unit 151, the suction holes 32*a* of the downstream side adjacent section 31*b* are positioned farther from the connection opening 33*a* as compared to the suction holes 32*a* of the printing section 31*a*, such that the gas suction routes of the negative-pressure generating device 34 become long. Therefore, in the medium adsorbing unit 151, adsorption power in the downstream side adjacent section 31*b* is lower than adsorption power in the printing section 31*a*.

Also, in the medium adsorbing unit 151, the suction holes 32*a* of the printing section 31*a* are positioned farther from the connection opening 33*a* as compared to the suction holes 132*a* of the upstream side adjacent section 31*c*, such that the gas suction routes of the negative-pressure generating device 34 become long. Further, the suction holes 132*a* of the upstream side adjacent section 31*c* are larger than the suction holes 32*a* of the printing section 31*a*, and thus can suck a larger amount of gas. Therefore, in the medium adsorbing unit 131, adsorption power in the printing section 31*a* is lower than adsorption power in the upstream side adjacent section 31*c*.

Figure 16:
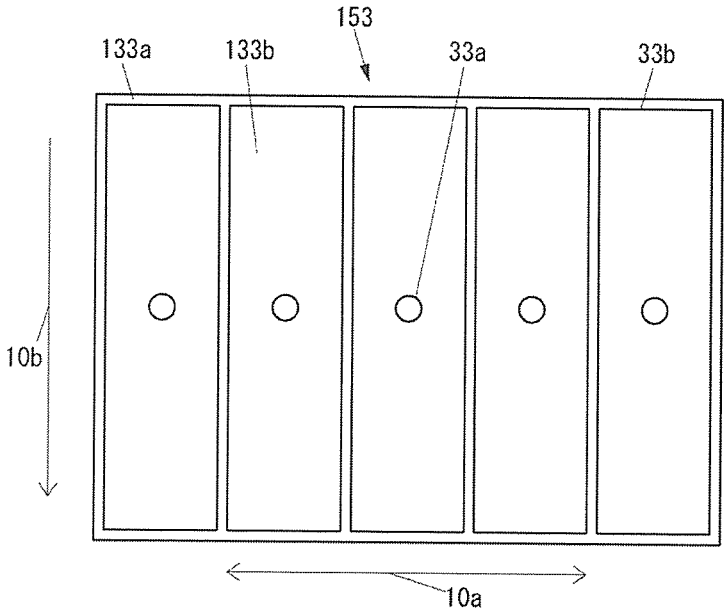
FIG. 16 is a plan view of the base plate of the inkjet printer according to the second embodiment of the disclosure, and is a view illustrating an example different from the example shown in FIG. 14.

Also, the inkjet printer according to the second embodiment may have a base plate 153 shown in FIG. 16, in place of the base plate 133. The base plate 153 has five connection chambers 33*b* independent from one another, and the five connection chambers 33*b* have connection openings 33*a*, respectively.

In a case where the inkjet printer according to the second embodiment has the base plate 153 shown in FIG. 16, since the plurality of connection openings 33*a* is formed in line in the main scan direction shown by the arrow 10*a*, it is possible to uniformize adsorption power in the main scan direction shown by the arrow 10*a*. Therefore, the inkjet printer according to the second embodiment can surely adsorb media 90 even at the end portions of the medium adsorbing unit 31 in the main scan direction shown by the arrow 10*a*.

Also, in the case where the inkjet printer according to the second embodiment has the base plate 153 shown in FIG. 16, since the connection states between the negative-pressure generating device 34 and some connection openings 33*a* of the plurality of connection openings 33*a* can be changed by the valves 35, whereby adsorption power generation positions on the medium adsorbing unit 31 in the main scan direction shown by the arrow 10*a* can be changed, in a case where the width of a medium 90 in the main scan direction shown by the arrow 10*a* changes, it is possible to suppress ink mist from being sucked from some suction holes 32*a* included in the plurality of suction holes 32*a* of the medium adsorbing unit 31 and having not faced the medium 90. Therefore, in a case where the widths of media 90 in the main scan direction shown by the arrow 10*a* change, the inkjet printer according to the second embodiment can suppress a reduction in adsorption power relative to media 90.

Also, in each embodiment described above, adsorption power in the downstream side adjacent section 31*b* is lower than adsorption power in the printing section 31*a*. However, according to the disclosure, adsorption power in the downstream side adjacent section 31*b* may be the same as adsorption power in the printing section 31*a*. In the inkjet printer, even in the case where adsorption power in the downstream side adjacent section 31*b* is the same as adsorption power in the printing section 31*a*, as compared to the related art, it is more difficult that ink mist generated by performing printing on media 90 by the inkjet heads 23 is sucked by the suction holes 32*a* of the downstream side adjacent section 31*b*. For this reason, the inkjet printer can suppress the inside of the medium adsorbing device 30 from being clogged by ink sucked from the suction holes 32*a* of the downstream side adjacent section 31*b*, and can suppress the internal space of the conveyance belt 43 from being clogged by ink sucked by the suction holes 32*a* of the downstream side adjacent section 31*b*. Therefore, even in the case where adsorption power in the downstream side adjacent section 31*b* is the same as adsorption power in the printing section 31*a*, the inkjet printer can suppress a reduction in adsorption power relative to media 90 as compared to the related art.

What is claimed is:

1. An inkjet printer, comprising:

a medium adsorbing device that includes a medium adsorbing unit which adsorbs a medium;

an inkjet head which faces a portion of the medium adsorbing unit with the medium interposed therebetween and performs printing on the medium with ink; and a medium conveying device that conveys the medium with respect to the medium adsorbing unit, wherein the medium adsorbing unit has an adsorption surface which adsorbs the medium, the medium adsorbing unit has a printing section and a downstream side adjacent section on a side of the adsorption surface, in the printing section, printing is performed on the medium by the inkjet head, the downstream side adjacent section is on a downstream side from the printing section in a medium conveyance direction of the medium conveying device and is adjacent to the printing section, and in the medium adsorbing device, adsorption power in the downstream side adjacent section is equal to or lower than adsorption power in the printing section.

2. The inkjet printer according to claim 1, wherein the medium adsorbing unit has an upstream side adjacent section on the side of the adsorption surface, and the upstream side adjacent section is on an upstream side from the printing section in the medium conveyance direction and is adjacent to the printing section, and in the medium adsorbing device, adsorption power in the printing section is lower than adsorption power in the upstream side adjacent section.

3. The inkjet printer according to claim 2, wherein the medium adsorbing device includes a suction power generating unit which generates gas suction power, and in the adsorption surface, a plurality of suction holes is formed so as to suck gas for adsorbing the medium, and the medium adsorbing unit has:

a connection opening which is connected to the suction power generating unit, and connection chambers which connect the suction holes to the connection opening, and in the medium adsorbing unit, the connection opening is formed at a position corresponding to the upstream side adjacent section.

4. The inkjet printer according to claim 3, wherein the inkjet head is movable in a main scan direction intersecting with the medium conveyance direction, in the medium adsorbing unit, a plurality of connection openings is formed in line in the main scan direction, and the connection chambers have grooves which extend in the medium conveyance direction and are connected to the suction holes.

5. The inkjet printer according to claim 4, wherein the medium adsorbing device includes a connection state changing device which can change at least the connection states between the suction power generating unit and a portion of connection openings of the plurality of connection openings.

6. The inkjet printer according to claim 5, wherein the inkjet head is movable in a main scan direction intersecting with the medium conveyance direction, and the medium adsorbing unit has an upstream side section on the adsorption surface, and the upstream side section is on the upstream side from the upstream side adjacent section in the medium conveyance direction, and in the upstream side section of the medium adsorbing device, a high adsorption power range in the main scan direction expands as going toward the downstream side in the medium conveyance direction.

7. The inkjet printer according to claim 3, wherein the inkjet head is movable in a main scan direction intersecting with the medium conveyance direction, and the medium adsorbing unit has an upstream side section on the adsorption surface, and the upstream side section is on the upstream side from the upstream side adjacent section in the medium conveyance direction, and in the upstream side section of the medium adsorbing device, a high adsorption power range in the main scan direction expands as going toward the downstream side in the medium conveyance direction.

8. The inkjet printer according to claim 4, wherein the inkjet head is movable in a main scan direction intersecting with the medium conveyance direction, and the medium adsorbing unit has an upstream side section on the adsorption surface, and the upstream side section is on the upstream side from the upstream side adjacent section in the medium conveyance direction, and in the upstream side section of the medium adsorbing device, a high adsorption power range in the main scan direction expands as going toward the downstream side in the medium conveyance direction.

9. The inkjet printer according to claim 2, wherein the inkjet head is movable in a main scan direction intersecting with the medium conveyance direction, and the medium adsorbing unit has an upstream side section on the adsorption surface, and the upstream side section is on the upstream side from the upstream side adjacent section in the medium conveyance direction, and in the upstream side section of the medium adsorbing device, a high adsorption power range in the main scan direction expands as going toward the downstream side in the medium conveyance direction.

10. The inkjet printer according to claim 1, wherein the medium conveying device includes a mesh-like conveyance belt which is on the adsorption surface, and on which the medium is loaded, and which conveys the medium with respect to the medium adsorbing unit.

* * * * *